US005302145A

United States Patent [19]

Spinnato et al.

[11] Patent Number: 5,302,145

[45] Date of Patent: Apr. 12, 1994

[54] FEMALE ELASTIC-BLADE CONTACT AND BLADE FOR SUCH A CONTACT

[75] Inventors: Gilbert Spinnato, Guyancourt; Yves Dohan, Paris, both of France

[73] Assignee: Souriau et Cie., Versailles, France

[21] Appl. No.: 946,671

[22] Filed: Sep. 18, 1992

[30] Foreign Application Priority Data

Sep. 19, 1991 [FR] France ..... 91 11561

[51] Int. Cl.[5] ..... H01R 13/00

[52] U.S. Cl. ..... 439/843

[58] Field of Search ..... 439/842-847, 439/851, 852, 856, 857, 861, 81, 82

[56] References Cited

U.S. PATENT DOCUMENTS 3,120,989 2/1964 Solorow ..... 439/843

FOREIGN PATENT DOCUMENTS 1130881 6/1962 Fed. Rep. of Germany ..... 439/843
1590457 7/1970 Fed. Rep. of Germany .
1247969 10/1959 France .
1442438 5/1966 France ..... 439/843
21378 of 1896 United Kingdom .

*Primary Examiner*—Joseph H. McGlynn
*Attorney, Agent, or Firm*—Pollock, Vande Sande & Priddy

[57] ABSTRACT

The blade (12) is intended for a female contact for an electrical connector and arranged in order to extend into an elongate slot of a tubular socket of the contact by bearing against an external tube and by being engaged inside this socket and radially movable in an elastic fashion when a pin of an associated male contact is introduced into the socket. It comprises a central portion (13) bearing against the external tube, located between a tail end (7) and a contact end (9), which has a continuous longitudinal curvature of large radius and without folding so that the bearing surface. (T) of the blade against the external tube moves longitudinally when the contact end of the blade is stressed radially; two inertia-reducing zones (15, 16) capable of causing flexure of the blade and respectively located between the tail portion (7) and the bearing portion (13) and between the latter and the contact portion (9); and a predetermined transverse curvature in its contact and bearing portions so that the latter have a desired stiffness.

8 Claims, 3 Drawing Sheets

FEMALE ELASTIC-BLADE CONTACT AND BLADE FOR SUCH A CONTACT

FIELD OF THE INVENTION

The present invention relates to improvements made to female elastic-blade contacts intended to equip electrical connectors and including:

a rigid tubular socket whose wall is pierced by a longitudinal slot, a blade supported by a tail end by the tubular socket so, that it extends into the above mentioned slot, the blade having its other contact end engaged inside the tubular socket, and radially movable in an elastic fashion, and, an external protecting tube surrounding the socket and serving as a bearing surface for the blade.

The invention aims more particularly, although not exclusively, at female contacts for connectors intended for space applications, which contacts, taking into account particular features inherent in a space environment (vacuum, weightlessness, significant thermal differences, impossibility for corrective maintenance), must meet requirements for reliability, long service life and optimal reduction of the insertion/extraction forces.

For (circular or rectangular) connectors produced for terrestrial applications, recourse is generally had to male contacts constituted by a smooth pin 1 (see FIG. 1 illustrating schematically an arrangement in accordance with the current state of the art), the geometrical shape of the end 2 of which may be optimized so that insertion into a corresponding female contact 3 is progressive and avoids excessively abrupt insertion forces.

The female contact 3 may be in the form of a socket split into two or more portions elastically moving apart radially under the pressure of the pin 1 of the male contact.

The female contact 3 as represented in FIG. 1, may also be in the form of an assembly of three parts, namely: a rigid tubular socket 4 whose wall is pierced by a longitudinal elongate slot 5; a blade 6 supported by a tail end 7 by the rear end 8 of the tubular socket 4 so that this blade extends into the above-mentioned slot, the blade having its other contact end 9 engaged inside the tubular socket and radially movable in an elastic fashion; and an external protecting tube 10 which has no electrical function and which, surrounding the socket 3, serves as a bearing surface for the blade 6 and keeps it in place.

This second embodiment is used increasingly less in the industrial connector field because it involves higher manufacturing cost than the slit-socket female contact, which can be produced in a single step by state-of-the-art cutting machines combining several split-socket contacts become too expensive if they are produced from core-treated beryllium copper and, if they have to be manufactured in a non-treated material, they do not have the high safety margins required for space use.

The female blade contact which is represented in FIG. 1 also lacks a sufficient safety margin, due to the structure and the method currently employed for manufacturing the blades. In fact, as represented in FIG. 1, the contact end 9 of the blade 6 is obtained by a folding operation, at P, from a metal part which is initially straight in the longitudinal direction. When the contact end 9 is elastically stressed radially during insertion/extraction operations, it pivots with respect to the portion

11 in the area of the fold P, which acts as an articulation. This results in stress concentration and therefore marked fatigue of the metal in the area of the fold, and these are such that the safety factor is insufficient for certain applications such as space applications.

Moreover, in a female blade contact thus arranged, only the contact end 8 is movable, and it alone determines (particularly by its length and its inclination) the bearing force on the pin of the male contact and therefore the insertion/extraction force. The remainder of the blade is not involved in determining this force, and this results in a rigidity of the blade, considered in its entirety, which is too great for it to be possible to obtain an insertion/extraction force as low as would be desired for making connectors with a large number of contacts easily maneuverable.

SUMMARY OF THE INVENTION

The object of the invention is to remedy these drawbacks of prior art female blade contacts so that they better meet the various practical requirements in terms of reliability, of service life and of the value of the insertion/extraction force, in particular for specific applications such as those involving their use in a space environment.

To this end, a female blade contact defined in the preamble, being arranged in accordance with the invention is essentially distinguished in that the blade comprises a portion bearing against the external tube, which portion is located between the tail end and the contact end and has a continuous longitudinal curvature of large radius and without folding so that the bearing surface T of the blade against the external tube moves longitudinally when the contact end of the blade is stressed radially on introduction of a corresponding male contact, comprises two inertia-reducing zones capable of causing the blade to flex, these zones being respectively located between the tail portion and the bearing portion and between the bearing portion and the contact portion, and, has a predetermined transverse curvature in its contact and bearing portions so that said portions have a desired stiffness.

To simplify its manufacture the blade is advantageously constituted from a material of substantially constant thickness and the inertia-reducing zones are narrower than the contact, bearing and tail portions.

To ensure good interaction of the contact end with the pin of the associated male contact, and therefore a good electrical contact, together with flexibility and sufficient suppleness of the remainder of the blade, provision may be made for the width of the contact portion t be greater than that of the bearing and tail portions.

Still with the aim of simplifying the manufacture of the blade, it is advantageous for its transverse curvature to be substantially constant over the entire length of the contact and bearing portions.

The blade constituted according to the invention can exhibit a very great facility for deformation without, however, there being a stress concentration.

The elimination of the fold P of the prior art blade prevents the localization of the deformation forces; on the contrary, the blade of the invention bearing against the external tube "rolls" on the latter. A longitudinal curvature of large radius of the blade allows the point bearing on the external tube to move forward when the radial deformation increases; this has the beneficial effect of reducing the bending moment and the stress at the point of contact and therefore increases the safety factor. The movement the point of bearing on the tube is facilitated by supplenesses created by:

the forward narrowing, associated with a lesser stiffness of the cross section which results from this narrowing and which allows greater relative deformation of this portion when the bearing point is moved forward;

the rear narrowing, providing greater flexibility for this portion such that the rear section of the blade, instead of constituting a rigid fitting, flexes under the effect of the movement of the point of bearing caused by the force deforming the contact end and provides an additional possibility for rotation of the blade about the point of rolling.

The elastic deformation limit can be increased by the use of core-treated beryllium copper, which remains possible within acceptable cost conditions, by producing the blade from a thin strip of beryllium copper.

By virtue of these dispositions, which distribute the stresses over the entire surface of the part by preventing the stress concentrations encountered in the past, a significant safety margin, greater than 2, is observed between the range of normal use and the limiting deformation of the permanent-deformation zone.

Through homothetic transformation, the same geometry is applicable to a wide range of contact dimensions.

Finally, the process for manufacturing the blade is simplified since a cutting-out operation is performed flat from a material (beryllium copper) in strip or sheet form, followed by transverse bending over a mandrel of simple cylinder-of-revolution shape and by a longitudinal bending step. Finally, a core treatment of the material is performed on the entire, blade.

BRIEF DESCRIPTION OF THE DRAWINGS

The invention will be better understood on reading the following description of a preferred embodiment, given solely by way of example. And with, reference to the attached drawings, in which.

DESCRIPTION OF THE PREFERRED EMBODIMENT

Figure 1:
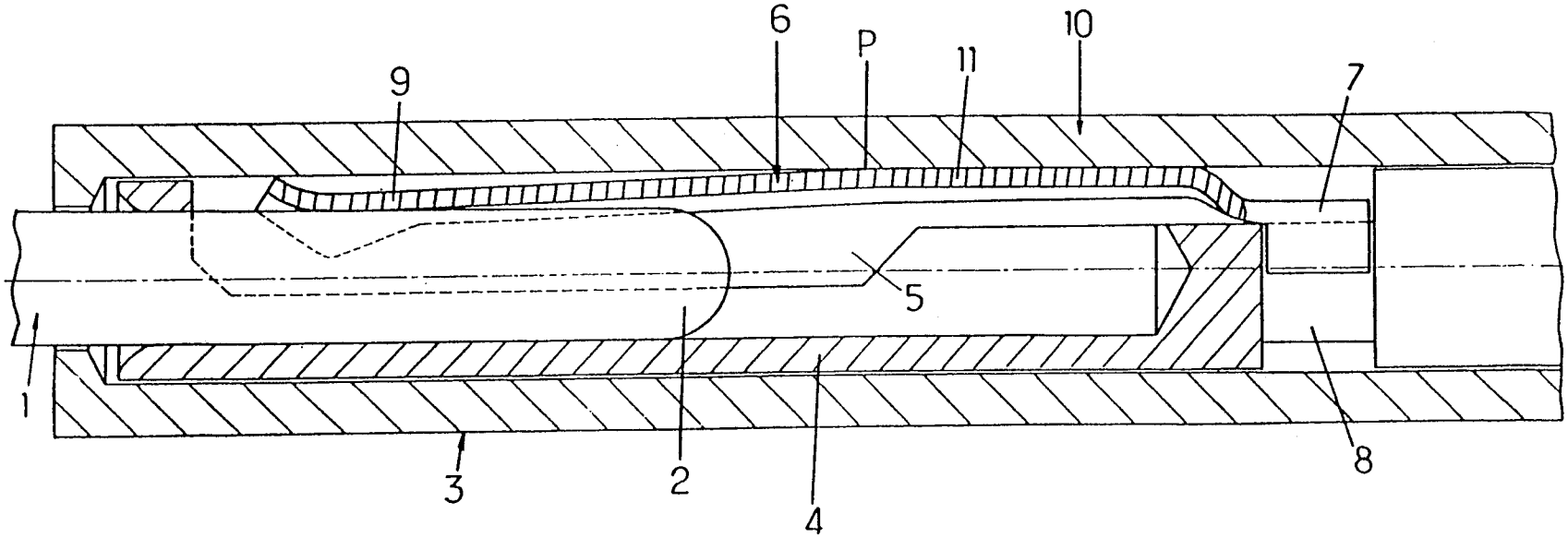
FIG. 1. (PRIOR ART)
FIG. 1 is a side view of a prior art blade contact.
Figure 2:
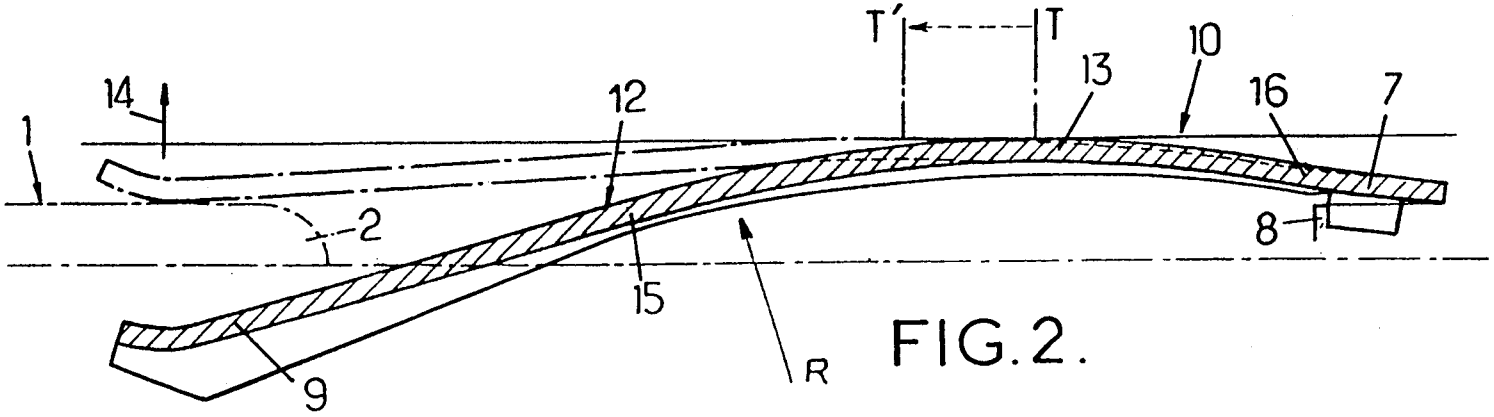
FIG. 2 is a side view of a blade arranged in accordance with the invention.
Figure 3:
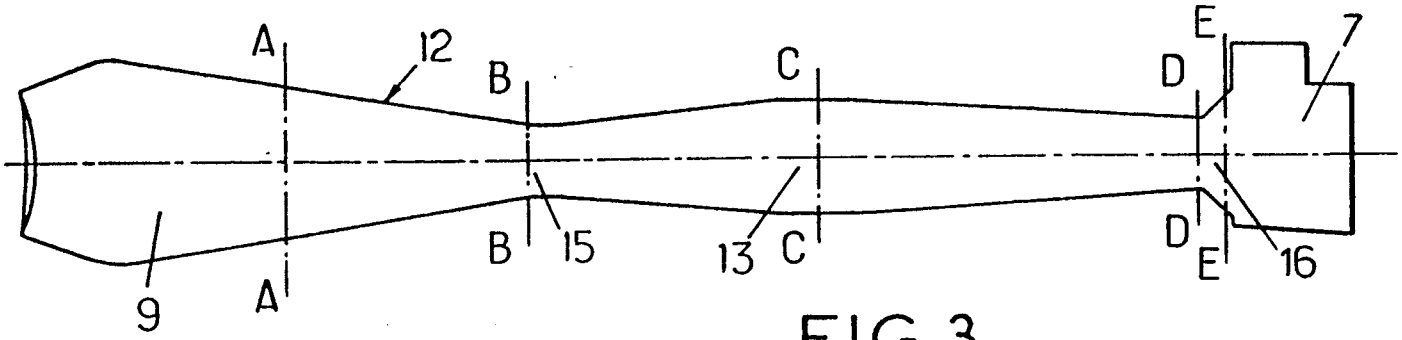
FIG. 3 is a plan view of the blade of FIG. 2.
Figure 4E:
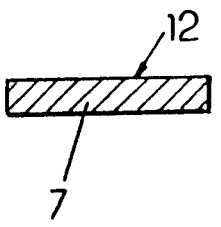
FIGS. 4A to 4E are transverse sectional views, respectively along lines A—A to E—E of the blade FIG. 3.
Figure 4D:
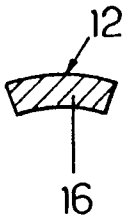
Figure 4C:
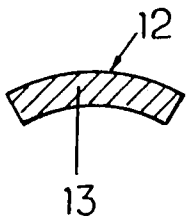
Figure 4B:
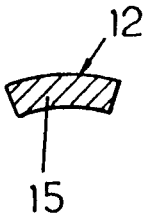
Figure 4A:
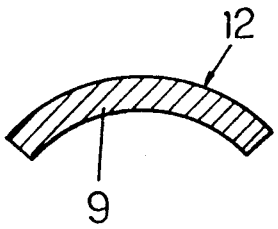

Referring now to FIGS. 2 to 4 (in which the same numerical references as in FIG. 1 are used for designating identical components), the invention makes provision for equipping the female contact 3 shown in FIG. 1 with a blade 12.

In the form of an elongate metal strip, for example made from beryllium copper, whose contact portion 9 located towards the front and whose tail portion located towards the rear are separated by a bearing portion 13 which has a continuous curvature of large radius, without folding, by means of which it bears, at T, against the external tube 10.

In order for this blade to have sufficient stiffness, taking into account its relatively small thickness, the metal strip is bent transversely over its entire length with the exception of the tail 7, which can remain flat. The radius of curvature of the transverse bend is constant over the entire length of the blade.

In order to increase the longitudinal flexibility of the metal strip and to make all the portions of the blade contribute to the deformation when the contact end 9 is stressed transversely (arrow 14), the strip is provided with inertia-reducing zones capable of promoting the flexure of the blade. This inertia reduction is produced here by a reduction in the width of the metal strip in two location namely at 15 between the contact end 9 and the bearing portion 13, and at 16 between the bearing portion 13 and the tail portion 7.

Lastly, in order to ensure optimum quality of the electrical contact with the pin 1 of an associated male contact, the contact portion 9 is enlarged with respect to the remainder of the metal strip.

Finally, the blade has, in plan view (FIG. 3) a contour having a variable width which, in combination with the transverse curvature of longitudinally constant radius, leads to a component having a longitudinally variable stiffness and controlled longitudinal flexibility. The transverse cross section of the various portions of the blade are shown in FIGS. 4A to 4E, namely: a transverse cross section of the enlarged contact portion in FIG. 4A corresponding to the line A—A of FIG. 3; a first narrowed section 15 in FIG. 4B corresponding to the line BB of FIG. 3; a bearing portion 13 in FIG. 4C corresponding to the line C—C of FIG. 3; a second narrowed section 16 in FIG. 4D corresponding to the line D—D of FIG. 3; and, lastly, a flat tail portion 7 in FIG. 4E corresponding to the line E—E of FIG. 3.

During a connection operation, the introduction of the pin 1 of a male contact into the female socket causes the transverse lifting (arrow 14) of the blade 9 and the bearing portion 13 "rolls" against the external tube 10. The bearing point T moves as far as T' (FIG. 2). Simultaneously, the present one of the two reduced-inertia zones causes flexure of the portion located between the bearing surface T and the tail 7 which accompanies the lifting of the forward portion of the blade.

This controlled deformation of the blade in its various zones allows, in order to obtain good-quality electrical contact with the male pin 1, the bearing force of the contact portion 9 on the pin and hence the wear of these components, to be reduced.

Such a conformation allows the metal to be worked well below the elastic deformation limit (for example, in a deformation range corresponding to about one half the value of this limit, i.e., with a safety factor of 2), and thus ensures that the metal will never be made to work in the permanent-deformation zone.

Furthermore, a blade thus constituted can be produced from a material having highly elastic properties, such as core-treated beryllium copper, according to a manufacturing process which is simpler than that required by female contacts made as a single part. Here, the blade is cut out flat as a single part from a sheet of material and then bent transversely and longitudinally; it is subsequently core treated in its entirety.

A blade according to the invention has been produced from beryllium copper core treated in its entirety, with the following geometrical characteristics:

| | |
|---|---|
| length of the blade | 8.3 mm |
| thickness of the material | 0.15 mm |
| longitudinal radius of curvature of the bearing portion 13 | 12.1 mm |
| transverse radius of curvature | 0.65 mm |

-continued

| | |
|---|---|
| width of the portions bent | |
| at AA | |
| at BB | 0.5 mm |
| at CC | 0.8 mm |
| at DD | 0.5 mm |
| beryllium copper material, UBe2: | 30 to 40 g |
| bearing force of the contact portion on an associated pin | |

We claim:

1. A female contact for an electrical connector, comprising:

(a) a rigid tubular socket having a wall pierced by a longitudinal slot;

(b) a blade supported by a tail end by said tubular socket so that it extends into said slot, said blade having a contact end opposite said tail end engaged inside said tubular socket and radially movable in an elastic fashion; and (c) an external tube surrounding said tubular socket and serving as a bearing surface for said blade;

(d) wherein said blade comprises:

(i) a portion bearing against said external tube and located between said tail end and said contact end, said blade having a continuous longitudinal curvature of large radius and without folding so that a surface of said blade bearing against said external tube moves longitudinally when said contact end of said blade is stressed radially on introduction of a corresponding male contact; and, (ii) two inertia-reducing zones capable of causing flexure of said blade and being respectively located between said tail end and said bearing portion and between said bearing portion and the contact end;

(iii) said contact portion and said bearing portion of said blade having a predetermined transverse curvature so that said portions have a desired stiffness.

2. A female contact as claimed in claim 1, wherein said blade has a substantially constant transverse curvature over the entire length of said contact and bearing portions.

3. A female contact as claimed in claim 1, wherein said blade is made of a material of substantially constant thickness and wherein said inertia-reducing zones are narrower than said contact, bearing and end portions.

4. A female contact as claimed in claim 1 or 3, wherein said contact portion is wider than said bearing and tail portions.

5. A blade intended for a female contact for an electrical connector and arranged to extend into an elongate slot of a tubular socket of said female contact by bearing against a tube external to said tubular socket in order for said blade to be engaged inside said tubular socket by being radially movable in an elastic fashion when a pin of an associated male contact is introduced into said tubular socket, said blade comprising:

(a) a central portion for bearing against said external tube, said central portion being located between a tail end and a contact end and having a continuous longitudinal curvature of large radius and without folding so that a surface of said blade bering against the external tube moves longitudinally when said contact end of said blade is stressed radially; and (b) two inertia-reducing zones capable of causing flexure of said blade and respectively located between said tail portion and a bearing portion and between said bearing portion and said contact portion;

(c) said bearing portion and said contact portion of said blade having a predetermined transverse curvature so that said portions have a desired stiffness.

6. A blade as claimed in claim 5, having a transverse curvature which is substantially constant over the entire length of said contact and bearing portions.

7. A blade as claimed in claim 5, made of a material of substantially constant thickness, and wherein said inertia-reducing zones are narrower than said contact, bearing and tail portions.

8. The blade as claimed in claim 5 or 7, wherein said contact portion is wider than said bearing and tail portions.

* * * * *